United States Patent [19]

Kurata

[11] Patent Number: 4,856,441

[45] Date of Patent: Aug. 15, 1989

[54] PILE YARN FEEDING DEVICE IN TUFTING MACHINE

[75] Inventor: Yoshiharu Kurata, Anou, Japan

[73] Assignee: Nakagawa Seisakusho Co., Ltd., Mie, Japan

[21] Appl. No.: 153,153

[22] Filed: Feb. 8, 1988

[30] Foreign Application Priority Data

Feb. 16, 1987 [JP] Japan ..... 62-32881

[51] Int. Cl.[4] ..... D05C 15/18

[52] U.S. Cl. ..... 112/80.73; 112/80.54

[58] Field of Search ..... 112/80.23, 80.54, 80.73

[56] References Cited

U.S. PATENT DOCUMENTS

| | | | |
|---|---|---|---|
| 2,880,684 | 2/1959 | Masland | 112/80.73 |
| 3,847,098 | 11/1974 | Hammel | 112/80.73 |
| 4,608,935 | 9/1986 | Bardsley | 112/80.73 |

*Primary Examiner*—Ronald Feldbaum

*Attorney, Agent, or Firm*—Barnes, Kisselle, Raisch, Choate, Whittemore & Hulbert

[57] ABSTRACT

A pile yarn feeding device in tufting machine comprising a plurality of rolls installed above and below the upper part of the tufting machine and rotated at a different speed to each other and some idler roll devices oppositely arranged against each of the rolls and having idler rolls advanced to and retracted from the rolls.

2 Claims, 3 Drawing Sheets

PILE YARN FEEDING DEVICE IN TUFTING MACHINE

FIELD OF THE INVENTION

The present invention relates to a pile yarn feeding device in a tufting machine.

RELATED ART STATEMENT

As disclosed in each of the gazettes of Japanese Patent Publication No. 55-103351, Japanese Utility Model Publication No. 59-31752 and Japanese Patent Laid-Open No. 61-19856, there has been developed in recent years a technology for forming pile loop and a cut loop or a high loop and a low loop into various patterns when a tufted carpet is formed with a tufting machine.

That is, in the tufting machine, pile yarns are pierced into a base fabric with needles and the produced piles are tufted. When a pile length is to be elongated, a large amount of pile yarns are fed to the needles and in turn when the pile length is to be shortened, a feeding amount of pile yarn is reduced. In this way, an amount of fed pile yarns is adjusted to make a difference in heights of the piles and to form a desired pattern. As one example, the gazette of Japanese Patent Publication No. 39-16426 discloses that each of several tens to several hundreds of pile yarns to be arranged within a specified tuft width is passed through separate feed rolls, speeds of these feed rolls are adjusted for every stitch cycle to vary a feeding amount and thereby a length of loop pile is varied.

There are provided 240 sets of pile yarns feeding devices for carrying out such an action as above over an entire front width of the tufting machine, and for example, as shown in a side elevational view of FIG. 4, they are constructed by arranging a total number of 240 sets in two stages of upper 120 sets and lower 120 sets of rows of rolls 1 and 2 with three rolls 1*a*, 1*b* and 1*c*, and 2*a*, 2*b*, and 2*c*, respectively, being applied as one group, pile yarns 3*a* and 3*b* in adjoining stitch rows pass through rows of rolls 1 and 2, pass through a tube bank 4 and then are fed to needles 6 arranged in numbers corresponding to the number of stitch rows while being tensioned with pulling rolls 5 and finally tufted into a base fabric 8 by needles 6 driving by a rocking shaft 7.

Thus, each of the rolls 1*a*, 1*b* and 1*c* stores an electromagnetic clutch (not shown), wherein the roll 1*a* is installed at a low speed rotary shaft 9*a* having a length extending over an entire front width of the tufting machine, the roll 1*b* is installed at an intermediate rotary shaft 9*b* and the roll 1*c* is installed at a high speed rotary shaft 9*c*, respectively. Each of the rolls 1*a*, 1*b* and 1*c* is constructed to be connected and rotated by gears (not shown).

Thus, in case that a signal produced from a computer storing a predetermined pattern or a pattern control device (not shown) such as a pattern drum using a photoelectric tube is a signal for performing a low speed supplying of pile threads, a signal is applied to an electromagnetic clutch of the roll 1*a*, the electromagnetic clutch is operated to cause the low speed rotation of the rotary shaft 9*a* to be transmitted to the roll 1*a* and at the same time, the low speed rotation of the roll 1*a* is transmitted to the rolls 1*b* and 1*c* through gears and then the pile yarn 3*a* is fed out through the rows of rolls 1 at a low speed.

Similarly, when the pile yarn feeding is to be carried out at a medium speed, a signal from the pattern control device is transmitted to an electromagnetic clutch of the roll 1*b* to cause the electromagnetic clutch to be operated to transmit the mediate rotation of the rotary shaft 9*b* to the roll 1*b*, the mediate rotation of the roll 1*b* may rotate the rolls 1*a* and 1*c* at the same speed through gears, the pile yarn 3*a* is fed out through the row of roll 1 at medium speed and further in case that the pile yarn is to be fed at a high speed, a signal from the pattern control device is transmitted to an electromagnetic clutch of the roll 1*c*, the electromagnetic clutch is operated to transmit a high speed rotation of the rotary shaft 9*c* to the roll l*c*, the high speed rotation of the roll 1*c* may rotate the rolls 1*a* and 1*b* at the same speed through gears, the pile yarn 3*a* is fed out at a high speed through the row of rolls 1, thereby a pile yarn feeding speed in respect to the needle is varied in sequence to control the pile yarn length to be tufted to the base fabric and a predetermined pattern setting is carried out.

Each of the rolls composed of three rolls 1*a*, 1*b* and 1*c* provided in the tufting machine performs the above-mentioned action in response to a signal from the pattern control device for every roll rows to vary the pile yarn feeding speed, resulting in that a complex pattern is generated in response to a length of the pile. As a new signal is transmitted from a pattern control device, an electromagnetic clutch of the roll which has been rotated up to now is released, the electromagnetic clutch to which a new signal is transmitted is operated to perform a variation of the pile yarn feeding speed instantaneously.

As described above, in a normal tufting machine having 240 sets of rows of rolls composed of three rolls 1*a*, 1*b* and 1*c*, each of 240 pile yarns is passed through the rows of rolls in case of applying equal number of rows of stitch of 240 and supplied to each of 240 needles and so it is not necessary to provide a tube bank 4.

However, in case that various pile thread feeding speeds were realized to make a complex pattern composed of various kinds of pile lengths, it was necessary to increase the number of rolls in a row of rolls or widen a weaving width of a carpet and for example when the row of stitches was increased up to 480 or 1200 or the like, the pile yarns corresponding to the number of rows of stitches should be used. However, in the conventional type of tufting machine composed of the above-mentioned constitution, an increasing of the row of rolls more than 240 sets was substantially difficult in view of a structure of the electromagnetic clutch stored in the rolls constituting the row of rolls, an installing space for a shaft to which the rolls were installed and other problems in constitution or mechanisms of each of the component elements and thus a trend of making a large-sized tufting machine could not be avoided. Due to this fact, in the conventional system, a plurality of pile yarns taken out from several packages were supplied to one row of rolls and the pile yarns fed out together were distributed to the row of stitches requiring the pile yarns so as to produce a pattern in the tube bank 4.

In the conventional type of the tufting machine described above, there was a restriction in the number of rows of rolls capable of being installed in the tufting machine and the number of rolls in the row of rolls was also restricted, and when a weaving width of the carpet was widened and the number of rows of stitches was increased, it was necessary that the pile yarns taken out from several packages were fed to one row of rolls and distributed to the row of stitches requiring the pile yarns so as to produce a pattern in the tube bank. As a result, it was acknowledged that the pile length of the pile yarn to be tufted on the base fabric was also restricted and so the carpet having more complex pattern was hard to produce.

OBJECT AND SUMMARY OF THE INVENTION

It is an object of the present invention that an entire device of a tufting machine is made compact.

It is another object to provide a pile yarn feeding device in which a feeding amount of a pile yarn is varied in several manners to cause a length of loop pile to be complex one and to generate a height difference in the produced pile.

A pile yarn feeding device in a tufting machine of the present invention has resolved the problems described above by an arrangement comprising a plurality of rolls installed above and below the upper part of the tufting machine and rotated at a different speed to each other and idler roll devices having idler rolls oppositely arranged against each of the rolls, receiving a signal from a pattern control device, and being advanced or retracted to abut against or move away from the rolls. Several idler roll devices are arranged in an axial direction of each of the rolls in an equally spaced-apart relation to each other.

Since the pile yarn feeding device of the present invention in a tufting machine is constructed as described above, only the specified idler roll on the idler roll devices receiving a signal from the pattern control device is operated and advances in response to the signal to hold the pile yarn between it and the opposing roll, feed out the pile yarn at a speed corresponding to a rotational speed of each of the rolls and vary an amount of supplied pile yarns in respect to the base fabric.

DETAILED DESCRIPTION OF PREFERRED EMBODIMENT

Figure 1:
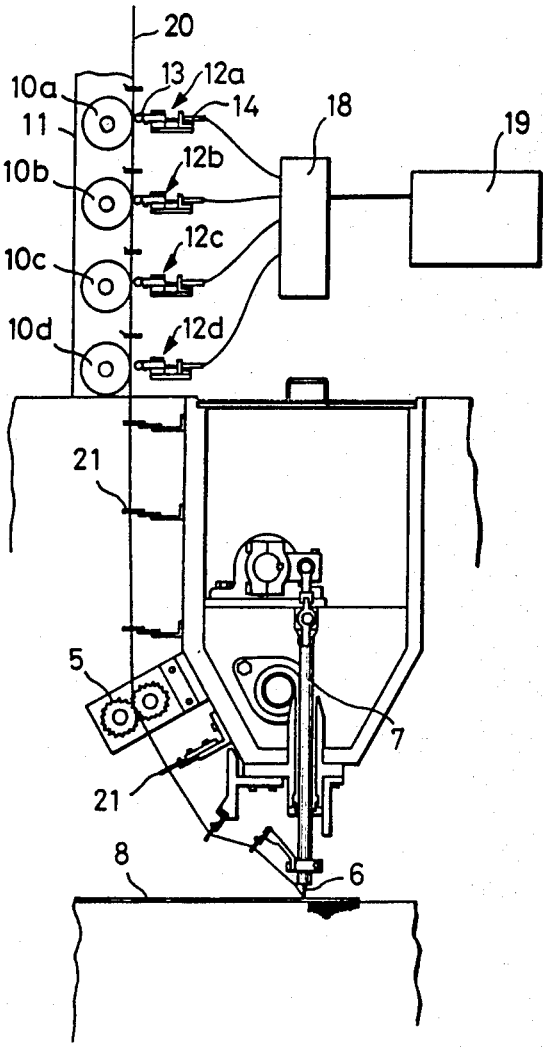
FIG. 1 is a schematic side elevational view for showing a tufting machine provided with a pile yarn feeding device of the present invention.
Figure 2:
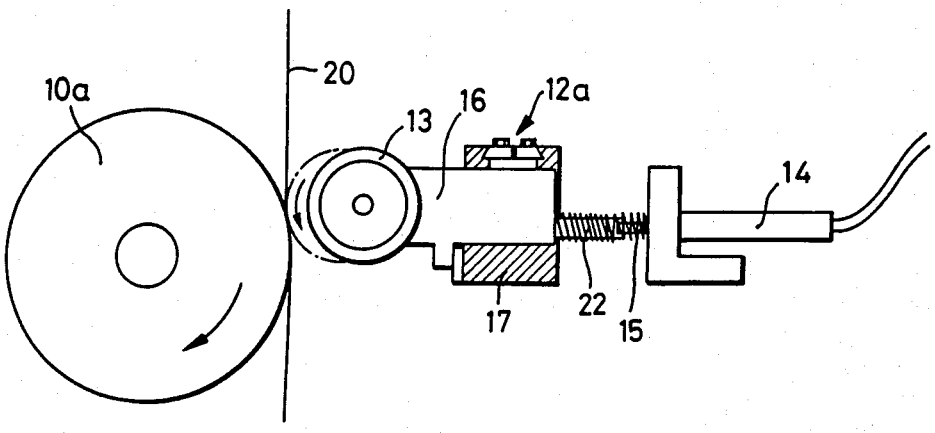
FIG. 2 is a side elevational view for showing a relation between rolls and idler rolls in a pile yarn feeding device of the present invention.

Referring now to FIGS. 1 and 2, one preferred embodiment of the present invention will be described.

10*a*, 10*b*, 10*c* and 10*d* designate rolls provided with a crape surface at each of their circumferential surfaces to increase a frictional resistance, the rolls are installed at the upper and lower portions of the upper stand 11 of the tufting machine, each of the rolls 10*a*, 10*b*, 10*c* and 10*d* has a length extending over an entire front width of the tufting machine and is a positive driving roll rotated at a different speed to each other.

12*a*, 12*b*, 12*c* and 12*d* designate idler roll devices arranged to be opposite against each of the rolls 10*a*, 10*b*, 10*c* and 10*d* and equally spaced-apart in an axial direction of each of the rolls, the idler roll devices 12*a*, 12*b*, 12*c* and 12*d* are provided with an idler roll 13 at each of their ends, and each of the idler rolls is comprised of a supporting shaft 16 connected to a shaft 15 of an air cylinder 14 at the other end thereof and a supporting member 17 for the supporting shaft 16. The supporting shaft 16 is slid on the supporting member 17 under an operation of the air cylinder 14, advances and retracts thereon to cause an idler roll 13 at the extremity end of the supporting shaft 16 to be abutted against or moved away from the roll.

Termination of supplying of air to the air cylinder 14 is performed by a method wherein a group of electromagnetic valves 18 corresponding to each of the air cylinders 14 are provided, the electromagnetic valve of the group of electromagnetic valves is selectively operated in response to a signal produced from a computer storing a predetermined pattern or a pattern control device 19 such as a pattern drum using a photoelectric tube.

The pile yarn feeding device in the tufting machine of the present invention is composed of the above-mentioned arrangement, whrein the pile yarn 20 supplied from above passes between the rolls 10*a*, 10*b*, 10*c* and 10*d* and the idler rolls 13 on the idler roll devices 12*a*, 12*b*, 12*c* and 12*d*, reaches to the needle 6 driven by a rocking shaft 7 while a tension force is being applied by the pulling rolls 5 and then the pile yarn is tufted into the base fabric 8. 21 denotes a yarn guide arranged in a passage of the pile yarn 20.

As an example, a case in which a signal generated by the pattern control device 19 energizes a specified electromagnetic valve in the group of electromagnetic valves 18 and air is fed to the air cylinder 14 on the idler roll device 12*a* will be described. At first, the air cylinder 14 on the idler roll device 12*a* is operated to advance the supporting shaft 16, the idler roll 13 at the extremity end of the supporting shaft 16 helds the pile yarn 20 between it and the roll 10*a* as shown by a dotted line in FIG. 2 and abutted against it and further rotated in synchronous with a rotation of the roll 10*a*, so that the held pile yarn 20 is fed out in compliance with a rotational speed of the roll 10*a* and then tufted into the base fabric 8 with a pile length corresponding to the feeding amount.

Then, as air is fed to the air cylinder 14 on the idler roll device 12*b* through the signal generated by the pattern control device 19, the idler roll 13 on the idler roll device 12*a* is moved away from the roll 10*a* under a biasing force of a spring 22 by being shut off for the supplying of air of the air cylinder 14*b*, the pile yarn 20 is held by the roll 10*b* and the idler roll 13 on the idler roll device 12*b* and is fed out in compliance with a rotational speed of the roll 10*b*, tufted into the basic fabric 8 with a pile length corresponding to the feeding amount. Similarly when the air cylinder 14*c* on the idler roll device 12*c* is operated, the pile yarn 20 is fed in compliance with a rotational speed of the roll 10*c*, and in turn when the air cylinder 14*d* on the idler roll device 12*d* is operated, the pile yarn 20 is fed out in compliance with a rotational speed of the roll 10*d*.

Further, since each of the rotational speeds of the rolls 10*a*, 10*b*, 10*c* and 10*d* is a different speed to each other, a feeding amount of the pile yarn is also different to each other, and the pile yarn is tufted into the basic fabric 8 with such a pile length as one corresponding to each of the feeding amounts, resulting in that its predetermined pattern stored in the pattern control device 19 can be produced on the base fabric 8.

In the above-mentioned preferred embodiment, the pile yarn supplying device of the present invention has been described as one in which four rolls 10*a*, 10*b*, 10*c* and 10*d* and four idler roll devices 12*a*, 12*b*, 12*c* and 12*d* are applied as one group. However, a more complex pattern can be produced by an arrangement in which several rolls are arranged at the upper and lower portions of the upper part of the tufting machine with a slight clearance being left without requiring a substantial space therearound, each of the rolls is rotated at a different speed to each other, the idler roll devices opposing to each of the rolls are also provided in an equal spaced-apart relation in an axial direction of each of the rolls.

Figure 3:
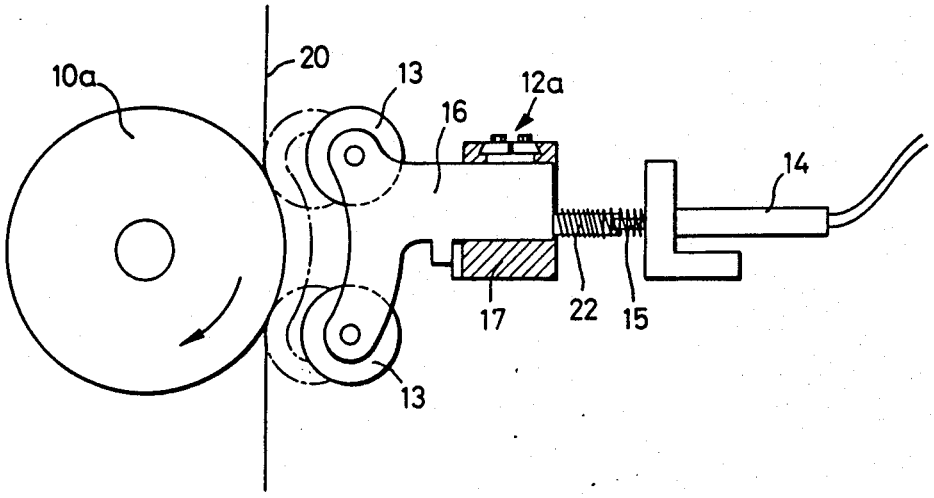
FIG. 3 is a side elevational view for showing another preferred embodiment of FIG. 2.
Figure 4:
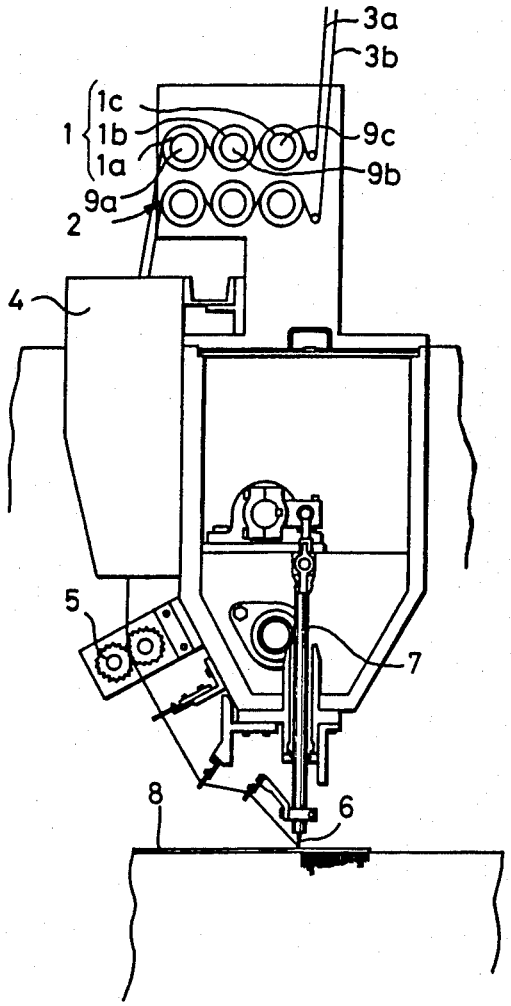
FIG. 4 is a schematic side elevational view for showing a tufting machine provided with the conventional type of pile yarn feeding device.

At the rear surface of the base fabric is arranged the conventional well-known looper device etc. to contribute to a formation of the pile yarn, the cylinder for advancing or retracting the supporting shaft of each of the idler rolls is not limited to the air cylinder, but other neumatic cylinder or hydraulic cylinder containing water or oil etc. may also be applied and the arrangement of two or more idler rolls on the idler roll devices on the extremity end of the supporting shaft as shown in FIG. 3 causes the pile yarn to be positively held.

As described in detail, the pile yarn supplying device in a tufting machine of the present invention is comprised of a plurality of rolls arranged at the upper and lower portions of the upper part of the tufting machine and idler roll devices provided with idler rolls oppositely arranged against each of the rolls, receiving a signal from the pattern control device to advance or retract, the idler roll devices are arranged with an equal spacing to each other in an axial direction of each of the rolls. So, an entire device can be made compact as compared with the conventional type of pile yarn feeding device comprised of several rows of rolls having electromagnetic clutches and several rolls are arranged at the upper and lower portions of the tufting machine with a slight clearance thereagainst without requiring any substantial spacing, each of the rolls can be rotated at a different speed to each other. Several idler roll devices can be oppositely arranged against each of the rolls and equally spaced apart to each other in an axial direction, the conventional type tube bank is eliminated and several rolls and idler roll devices can be provided, resulting in that a signal from the pattern control device can be divided into more segments, resulting in that a feeding amount of the pile yarn is varied in several manners to cause the length of loop pile to be complex one and to generate a height difference in the produced pile and so it is possible to realize the predesigned complex pattern stored in the pattern control device on the tuft carpet in an accurate manner.

What is claimed is:

1. A pile yarn feeding device in a tufting machine comprising:

(a) a plurality of driving rollers in a vertical bank each driven at a different speed, (b) pulling rollers for moving a plurality of horizontally spaced strands of pile yarn tangentially past said driving rollers, (c) a vertical bank of a plurality of horizontally spaced individual pressure rollers independent of the pulling rollers positioned adjacent each strand of pile and each driving roller, the center of each pressure roller being slightly offset vertically from the center of each pressure roller to which it is adjacent, and (d) projectable means mounting each pressure roller to move each pressure roller toward a driving roller to engage a pile strand between a pressure roller and a driving roller at an area slightly above the point of tangency of said strand and said driving roller to move the strand at a speed commensurate with the surface speed of a driving roller, (e) said pressure rollers being advanced and retracted upon reception of a signal from a pattern control device.

2. A pile feeding device as defined in claim 1 in which said projectable means comprises a driving cylinder and a group of electromagnetic valves, and pattern control device operates said valves selectively in response to a signal produced from a computer storing a predetermined pattern.

* * * * *